US005664781A

United States Patent [19]

Feola

[11] Patent Number: 5,664,781

[45] Date of Patent: Sep. 9, 1997

[54] METHOD AND APPARATUS FOR PLAYING A POKER-TYPE CARD GAME

[75] Inventor: John Feola, Medford, Mass.

[73] Assignee: New Vision Gaming and Development, Inc., Medford, Mass.

[21] Appl. No.: 720,560

[22] Filed: Sep. 30, 1996

[51] Int. Cl.[6] ..... A63F 1/00

[52] U.S. Cl. ..... 273/292

[58] Field of Search ..... 273/292, 293, 273/303, 274

[56] References Cited

U.S. PATENT DOCUMENTS

| | | | |
|---|---|---|---|
| 1,527,929 | 2/1925 | Simons | 273/274 X |
| 4,948,134 | 8/1990 | Suttle et al. | 273/85 CP |
| 5,257,789 | 11/1993 | Le Vasseur | 273/292 X |
| 5,257,810 | 11/1993 | Schorr et al. | 273/292 |
| 5,265,882 | 11/1993 | Malek | 273/292 |
| 5,382,025 | 1/1995 | Sklansky et al. | 273/292 |
| 5,395,120 | 3/1995 | Malek | 273/292 |
| 5,494,296 | 2/1996 | Grassa | 273/292 |
| 5,531,440 | 7/1996 | Dabrowski et al. | 273/292 X |

*Primary Examiner*—William E. Stoll

*Attorney, Agent, or Firm*—Morse, Altman & Benson

[57] ABSTRACT

A casino card game that allows players to wager against the casino using the rules of stud poker. A number of stud poker hands are dealt as lines on a playing surface and players wager as to which hand will have the highest stud poker ranking. The playing surface has a dealer position including a line for each hand dealt, and player positions in a semi-circle around the dealer position, each including a location at which wagers are placed. Game options include choosing the hand with the lowest ranking instead of the highest ranking, having indicators that indicate the hands with the currently highest and/or lowest ranking, requiring an ante or vigorish if only two hands are played, playing with more than one deck of playing cards, allowing one of the players to be the bank, playing on a video machine, a personal computer, a slot machine, over an on-line computer network, or on another type of one-way or interactive gaming or entertainment equipment, and playing with a match jackpot and/or a tough beat jackpot.

10 Claims, 3 Drawing Sheets

METHOD AND APPARATUS FOR PLAYING A POKER-TYPE CARD GAME

BACKGROUND OF THE INVENTION

Related Applications

The applicant wishes to claim the benefit under 35 U.S.C. §119(e) of provisional patent application Ser. No. 60/022,034, dated Jul. 22, 1996 for METHOD AND APPARATUS FOR PLAYING A POKER TYPE CARD GAME in the name of John Feola.

FIELD OF THE INVENTION

The present invention relates to a card game, more specifically, to a poker-type card game suitable for casino gambling, and to a layout specifically designed for playing the game.

THE PRIOR ART

Of the many card games used for gambling, poker is one of the most popular. Because of this popularity, many people how the rules of the game and feel comfortable playing the game. The many varieties of poker fall into two main categories, draw poker and stud poker. In draw poker, each player is allowed to exchange some of the initial cards for others, whereas in stud poker, no exchange is allowed. In the typical stud poker game, each player initially wagers a nominal amount, generally called the ante or vigorish, to signify that she is playing the hand. Wagers are indicated by any token that acceptably signifies value, such as cash or chips. After at least one card is dealt to each player, either face up, so that all players can see the card, or face down, so that only the player of the hand can see the card, as previously determined, a round of wagering occurs. The process of dealing cards to each player followed by a round of wagering continues until each player has the proper number of cards for the form of stud poker being played. After the last round of wagering, the winner is determined. When playing 5-card stud, the highest ranked poker hand using all five cards is the winner. When playing 7-card stud, the highest ranked poker hand using the best five of the seven cards is the winner. The ranking of poker hands, from best to worst, is as follows: royal flush, straight flush, four of a kind, full house, flush, straight, three of a kind, two pair, one pair, and highest cards.

Although many people know how to play poker and enjoy playing it, it is rarely used in casino gambling. The reason is that poker includes rounds of wagering, where the amount wagered changes depending upon what each player thinks her chances of winning are at any particular moment during the game. This type of gambling is not conducive to the casino environment, where it is desired that minimal or no discretion be vested in the employees of the gambling establishment, the dealers.

Because of the amount of discretion necessary, players typically play against each other rather than against the "house", the gambling establishment. The house typically provides facilities to the players including a dealer, the playing cards, and table. In order to compensate the house and to profit from the game, the house collects a nominal percentage of each player's wager, a fixed amount for each game, or a fixed amount for increments of time, such as an hour. Generally, this amount is less than the amount that would be made if the house was involved as a player in the game.

Many players do not like to play poker in this setting. They prefer to play against the house rather than against fellow players.

One solution is the electronic poker games that have become increasingly popular. The player wagers against the house, not other players, and the house keeps any winnings. Typically, wagers are made in fixed amounts by the player, so there is no need for the machine to make decisions. However, many players like the interaction with other players, dealers, and real playing cards that comes with the normal game of poker. For these people, the game itself is a social event that cannot be duplicated by electronic means.

Accordingly, it is an object of the present invention to provide a poker-type game that is suitable for use in casino gambling.

Another object of the present invention to provide a poker-type game where wagering occurs against the house rather than against fellow players.

Yet another object of the present invention to provide a poker-type game where the dealer has no discretion during the playing of the game.

A further object of the present invention is to provide a poker-type game that increases the revenue potential of the gambling establishment.

A still further object of the present invention is to provide a poker-type game where wagering occurs against the house with other players in a social setting.

Other objects of the present invention will become apparent in light of the following drawings and description of the invention.

SUMMARY OF THE INVENTION

The card game of the present invention provides a game that allows players to wager with the house as the banker using the rules of stud poker. The game is played with a standard 52-card deck of playing cards and the standard rules of stud poker apply to determine the winning hand.

Before the game begins, the house selects the type of stud poker to be played, either 5-card or 7-card stud, and the number of hands that will be played. The number of hands is not related in any way to the number of players and may be from two hands to the maximum number of hands of the selected game that can be made from a standard 52-card deck of playing cards.

The game is played on a playing surface that has a dealer position and a plurality of player positions. The dealer position has a plurality of identified locations, one for each hand to be dealt. Symbols indicate the identifier of each hand and where each hand is placed. The player positions are in a semicircle around the dealer position and each includes a symbol containing an identifier corresponding to each hand that will be dealt.

To begin the game, each player chooses the hand or hands that she thinks will have the highest stud poker ranking by wagering an amount on those hands. Wagers are placed in the appropriate identifier circles to indicate which hands the player is wagering on. Then the dealer deals out the previously selected number of hands. The cards are dealt a round at a time, a dealt round being at least one card to each hand. Players may optionally increase their wagers after each dealt round. After the last round is dealt and the wagering is complete, the winning hand is determined and the players choosing the hand with the highest ranking will receive a predetermined amount of winnings. The remainder of the wagers are collected for the house by the dealer.

There are a number of optional enhancements which may be combined as desired. Optionally, the hand with the lowest ranking, rather than the highest ranking, is chosen.

Optionally, there is an indicator on the playing surface that indicates the hand with the highest ranking after each dealt round. Optionally, a vigorish is required if there are only two hands played. Optionally, the game can be played with more than one 52-card deck of playing cards. Optionally, one of the players, rather than the casino, is the bank. Optionally, rather than being played on a table surface with a live dealer, the game is played on a video machine, a personal computer, a slot machine, over an on-line computer network, or on another type of one-way or interactive gaming or entertainment equipment. Optionally, a match jackpot and/or a tough beat jackpot may be played as an adjunct to the regular game. The match jackpot is won when there are at least two hands having the same highest ranking. The tough beat jackpot is won when a ranked hand is beaten by a hand with a higher ranking.

BRIEF DESCRIPTION OF THE DRAWINGS

For a fuller understanding of the nature and object of the present invention, reference is made to the accompanying drawings, wherein.

DETAILED DESCRIPTION

The card game of the present invention provides a game that allows players to wager against the gambling establishment, also called the "house", using the rules of stud poker. The game is played with a set of basic rules and includes a number of optional enhancements. Stud poker is used because there is no discretion vested in the house. Unlike draw poker, where the player of a hand can select which cards to replace, all the dealt cards in stud poker are played.

The basic game is played with the house as the bank, rather than against the other players. This means that it is irrelevant to each player how the other players are playing the game, for example, which poker hands they are wagering on and how much they are wagering.

Preferably, one standard 52-card deck of playing cards is used and the standard rules of the selected stud poker game apply to determine the winning poker hand. From best to worst, the standard ranked stud poker hands are a royal flush, straight flush, four of a kind, full house, flush, straight, three of a kind, two pair, one pair, and highest cards.

Before the game play begins, the house selects the type of stud poker to be played, either 5-card or 7-card stud, and the specific rules of the game, for example, which cards are dealt face up and face down. The cards dealt face up are visible to all the players and the cards dealt face down are not visible until after the wagering is complete and the winners are being determined.

The house also selects the number of poker hands that will be played. The number of poker hands is not related in any way to the number of players, so it does not matter how many players there are in the game. There may be from two poker hands to the maximum number of poker hands that can be made from a standard 52-card deck of cards for the selected game. For example, when 5-card stud is played, the maximum number of poker hands is ten (ten hands times five cards per hand is 50 cards, leaving two cards unused). When 7-card stud is played, the maximum number of poker hands is seven (seven hands times seven cards per hand is 49 cards, leaving three cards unused).

Figure 1:
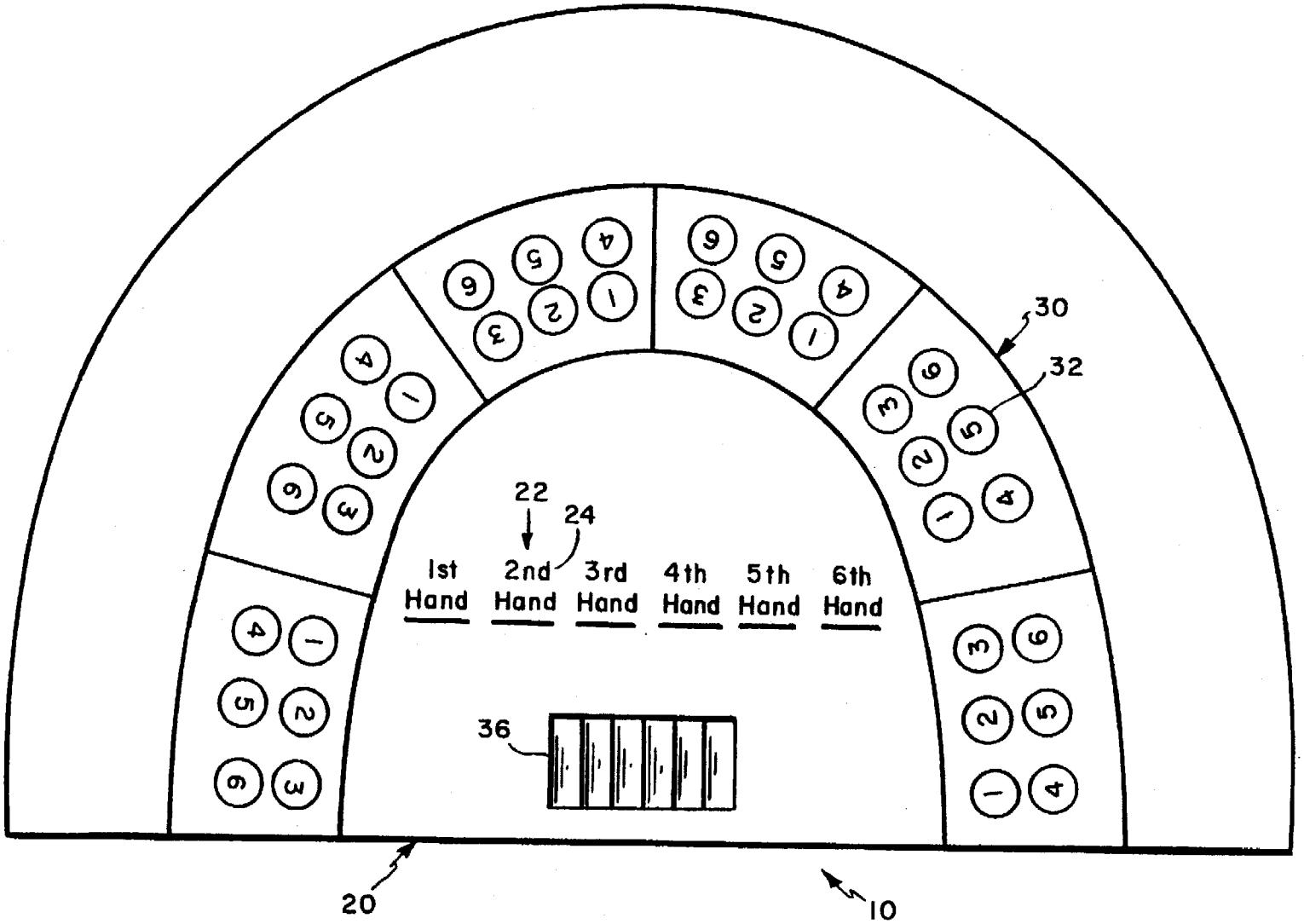
FIG. 1 shows a playing surface for a six-hand embodiment with vertical lines of the present invention.
Figure 2:
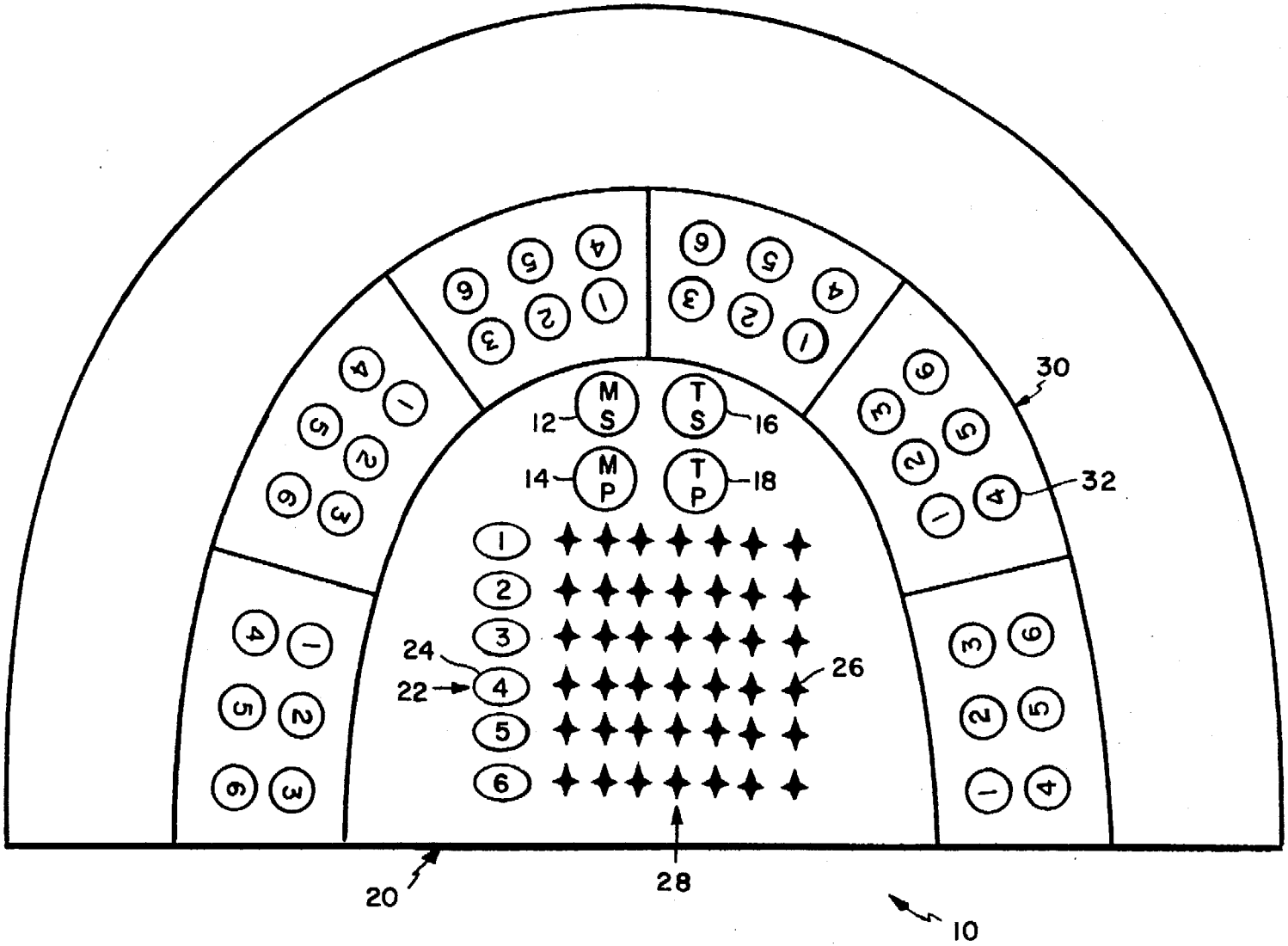
FIG. 2 shows a playing surface for a six-hand, 5-card stud embodiment with horizontal lines and optional enhancements.
Figure 3:
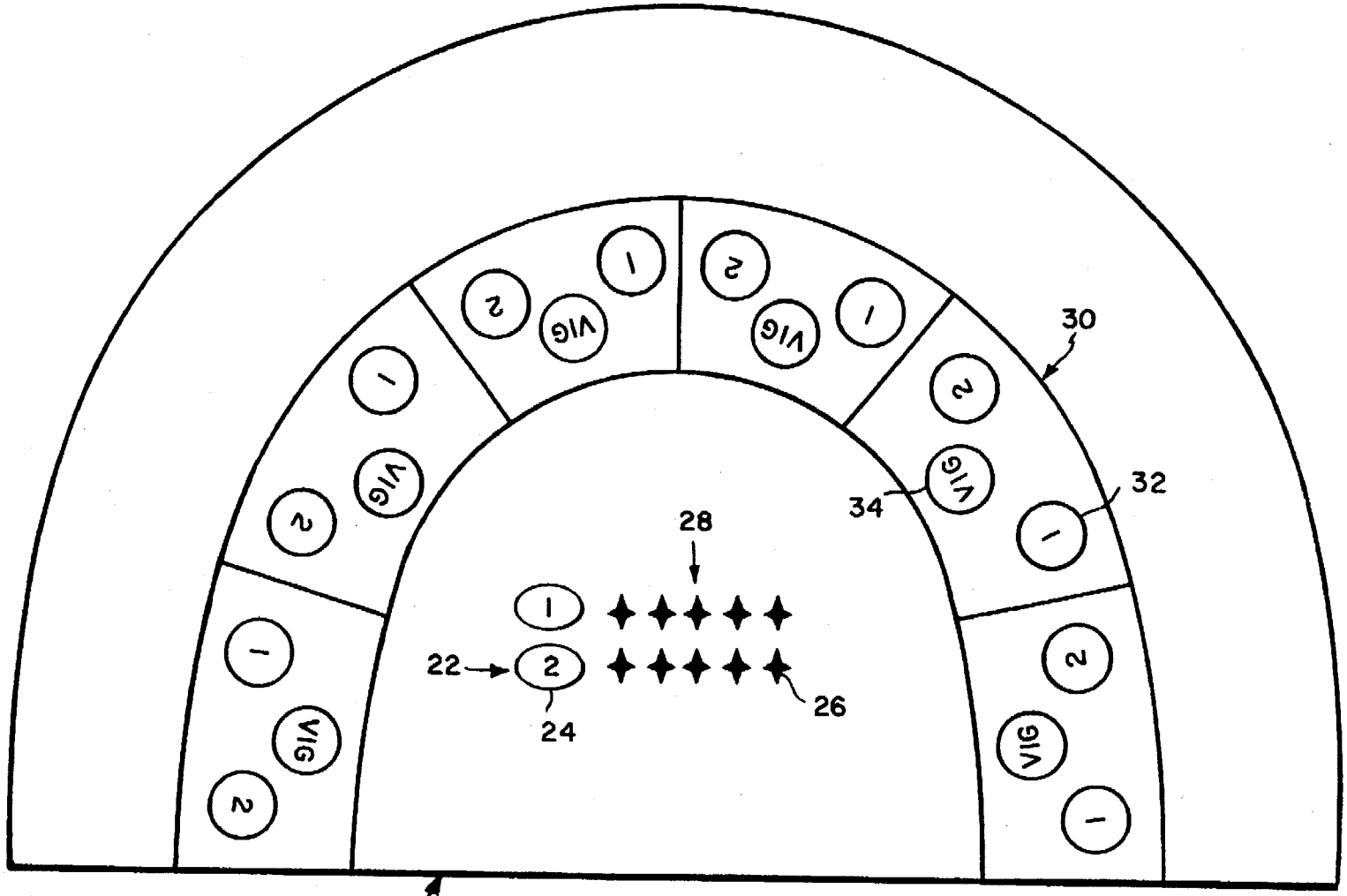
FIG. 3 shows a playing surface for a two-hand, 5-card stud embodiment with horizontal lines.

The selected game is played on a playing surface, typically a table top. Examples of several different surface layouts are shown in FIGS. 1–3. There are several aspects to the layouts that are common to all forms of the game. The dealer position 20 has a plurality of parallel lines 22, one for each hand to be dealt. The lines 22 may be vertical columns, as in FIG. 1, or horizontal rows, as in FIGS. 2 and 3. The symbol 24 at the end of the line 22 is the hand identifier, which are typically numerals running sequentially starting with "1". Optionally, there are symbols 26 in the line 22 indicating where each card of the hand is placed as it is dealt. Five card symbols 26 mean that the game is 5-card stud and seven card symbols 26 mean that the game is 7-card stud. When no card symbols 26 are present, the dealer announces the selected game, for example, verbally or by a sign located adjacent to the table.

Optionally, the playing surface 10 includes a rack 36 for holding gambling tokens, such as chips. The rack 36 is of a conventional design and is typically a plurality of parallel semicylindrical depressions in the playing surface 10.

Preferably, the player positions 30 are evenly spaced about a semicircle around the dealer position 20. Each player position 30 includes a symbol 32 containing an identifier corresponding to each line 22 that will be dealt a hand. Typically, there are six player positions 30, but the number of player positions 30 may vary.

To begin the game, each player chooses the hand or hands that she thinks will have the highest ranking by wagering an amount on those hands. The selections are made by placing the amount to be wagered on the corresponding identifier symbol 32 of the player position 30. The wagered amount is indicated by any tokens that acceptably signify value, such as cash or chips.

Next, the dealer deals out the selected number of hands and places them in the line 22 of the dealer position 20. If card symbols 26 are present, the cards are placed on these symbols 26. The cards are dealt a round at a time, a dealt round being at least one card to each hand. Players may optionally increase their wagers after each dealt round. Wagers are increased by adding tokens to the appropriate identifier symbol 32 in the player position 30. A player may stop wagering on any hand after any dealt round.

In a special case of the game, the only wagering that occurs is when the player selects the hand or hands that she thinks will win. No wagering occurs during the dealing of the cards.

After the last round is dealt and the wagering is complete, the winning hand is determined using the standard poker rankings, as described above. The players choosing the hand with the highest ranking receive a predetermined amount of winnings that is typically a multiple of the total amount that the player wagered on the winning hand. The winning multiple may be adjusted periodically by the house. Preferably, the winning multiple is based on the number of hands being played, because the chances of winning decrease as the number of hands increases. All losing wagers are collected by the dealer for the house.

There are a number of optional enhancements to the basic game. The first option is that, rather than the players choosing the hand with the highest ranking, the players choose the hand with the lowest ranking. An alternative to this option is that each player is free to choose whether she is wagering on the hand with the highest or lowest ranking. However, only one choice is allowed for each player in each game.

Optionally, there is an indicator on the playing surface that indicates which hand or hands currently has the highest ranking and/or an indicator on the playing surface that indicates which hand or hands currently has the lowest ranking. The indicators are moved by the dealer as necessary after each dealt round.

As stated above, the game can be played with only two hands. However, when two hands are played, the odds of winning are approximately even, as opposed to the odds being less than even when more than two hands are played. This removes the incentive that the gambling establishment has in providing the game. Therefore, each player may be required to place an ante or vigorish in addition to the wagers. The vigorish is placed on a separate vigorish symbol 34 in the player position 30, as shown in FIG. 3.

Optionally, the game can be played with more than one 52-card deck. By increasing the number of card decks, the number of hands that can be played in one game also increase by a proportionate amount. In addition, when using more than one deck, there are three additional ranked hands, a five of a kind, a two-pair flush, and a single-pair flush. A five of a kind is ranked between a straight flush and a four of a kind. A two-pair flush is ranked higher than a single-pair flush and both are ranked between a four of a kind and a full house.

Optionally, the game can be played where one of the players, rather than the gambling establishment, is the bank. The player may pay for the privilege of being the bank or the privilege may rotate among those players that wish to exercise the privilege. The establishment may require that the bank player pay a fee to the establishment for the privilege and to cover the costs to the casino of furnishing the playing facilities.

Optionally, rather than being played on a table surface with a live dealer, the game is played on a video machine, a personal computer, a slot machine, over an on-line computer network, or on another type of one-way or interactive gaming or entertainment equipment.

Optionally, a match jackpot may be played as an adjunct to the normal game. This jackpot is won when there are at least two hands having the same highest ranking. Prior to the beginning of play, the house determines how close two hands must be to qualify as having the same rank. For example, all straights may have the same rank or only straights with the same highest card may have the same rank.

Optionally, a tough beat jackpot may be played as an adjunct to the normal game. This jackpot is won when a ranked hand is beaten by another hand with a higher ranking. The house will determine which ranked hands are eligible for the tough beat jackpot prior to beginning game play.

If either the match jackpot or tough beat jackpot are offered, playing them is optional. Those players that do not choose to play either jackpot may still play the game. It is optional with the house whether or not to allow either jackpot to be played without also playing the game.

A jackpot may be "set" or "progressive". In a set jackpot, the amount put into the jackpot for each game is fixed, but the fixed amount may be adjusted periodically, for example, after the jackpot is won. In a progressive jackpot, the amount put into the jackpot increases for each game played during which the jackpot is not won. There may be a set jackpot, a progressive jackpot, or both for each of the match and tough beat jackpots. Intention to play a jackpot is indicated by placing a wager in one or more of special locations on or near the playing surface 10. For example, as in FIG. 2, there are separate locations on the playing surface 10 for the match set 12, match progressive 14, tough beat set 16, and tough beat progressive 18 jackpot wagers.

Only those players who wager a predetermined amount on a jackpot before a game are eligible to win that jackpot on the completion of that game. If more than one eligible player wins a set jackpot, each winner is paid a predetermined amount. If more than one eligible player wins a progressive jackpot, its value is divided equally among the winners.

Thus it has been shown and described a poker-type card game which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A method of playing a poker-type game with at least one standard deck of 52 playing cards, said method comprising the steps of:

(a) selecting a stud poker game;

(b) successively dealing rounds of said cards to build up a plurality of stud poker hands thereof;

(c) prior to and during said dealing, at least one player sporadically wagering on selected ones of said hands;

(d) at least one of said hands having a winning combination of said cards when said dealing is complete; and (e) any of said wagers identifying said at least one of said hands constituting a winning wager.

2. The method of playing a poker-type game of claim 1 wherein said stud poker game is selected from the group consisting of 5-card stud and 7-card stud.

3. The method of playing a poker-type game of claim 1 wherein said winning combination has the highest stud poker ranking of said hands.

4. The method of playing a poker-type game of claim 1 wherein said winning combination has the lowest stud poker ranking of said hands.

5. The method of playing a poker-type game of claim 1 wherein, prior to said dealing, said at least one player chooses whether said winning combination has the highest stud poker ranking of said hands or the lowest stud poker ranking of said hands.

6. The method of playing a poker-type game of claim 1 wherein, prior to said dealing, said at least one player wagers a vigorish.

7. The method of playing a poker-type game of claim 1 wherein said sporadic wagering occurs only prior to said dealing.

8. The method of playing a poker-type game of claim 1 wherein said sporadic wagering occurs after each of said rounds is dealt.

9. The method of playing a poker-type game of claim 1 wherein a match jackpot is provided, at least one jackpot player, prior to said dealing, wagering a match bet in said match jackpot, said at least one jackpot player winning a predetermined portion of said match jackpot if at least two of said hands have winning combinations.

10. The method of playing a poker-type game of claim 1 wherein a tough beat jackpot is provided, at least one jackpot player, prior to said dealing, wagering a tough beat bet in said tough beat jackpot, a predetermined portion of said tough beat jackpot being won by said at least one jackpot player after said hands are dealt if at least two of said hands have ranked combinations and one of said at least two of said hands is ranked higher than the remainder of said at least two of said hands.

* * * * *